US006701619B2

(12) United States Patent
Haruyuki

(10) Patent No.: US 6,701,619 B2
(45) Date of Patent: Mar. 9, 2004

(54) MANUAL SAFETY STRAIGHT RAZOR HAVING DOUBLE-SIDED BLADES

(76) Inventor: Kitano Haruyuki, 2-17, Imaizumi 3-chome, Utsunomiya City, Tochigi Prefecture (JP)

( * ) Notice: Subject to any disclaimer, the term of this patent is extended or adjusted under 35 U.S.C. 154(b) by 0 days.

(21) Appl. No.: 09/983,282

(22) Filed: Oct. 23, 2001

(65) Prior Publication Data

US 2002/0189105 A1 Dec. 19, 2002

(30) Foreign Application Priority Data

Jun. 19, 2001 (JP) ..... 2001-234215

(51) Int. Cl.[7] ..... B26B 21/10

(52) U.S. Cl. ..... 30/47; 30/30; 30/50; 30/55; 30/81

(58) Field of Search ..... 30/53, 55, 50, 30/30, 47, 62, 81, 77

(56) References Cited

U.S. PATENT DOCUMENTS

| | | | | | |
|---|---|---|---|---|---|
| 1,280,972 | A | * | 10/1918 | Dignam | 30/30 |
| 1,332,587 | A | * | 3/1920 | Yeomans | 30/30 |
| 1,401,915 | A | * | 12/1921 | Mainwaring | 30/50 X |
| 2,530,918 | A | * | 11/1950 | Taylor | 30/30 |
| 3,165,831 | A | * | 1/1965 | Carroll | 30/53 X |
| 3,456,340 | A | * | 7/1969 | Mondiello | 30/30 |
| 3,613,233 | A | * | 10/1971 | Lundell | 30/30 |
| 3,728,788 | A | * | 4/1973 | Pearson | 30/53 |
| 4,037,322 | A | * | 7/1977 | Bresler | 30/53 |
| 4,665,615 | A | * | 5/1987 | Martinez | 30/53 |
| 4,920,644 | A | * | 5/1990 | LaGattuta | 30/50 X |
| 5,649,364 | A | * | 7/1997 | Ilanlou | 30/50 X |
| 6,164,290 | A | * | 12/2000 | Andrews | 30/30 X |

FOREIGN PATENT DOCUMENTS

| | | |
|---|---|---|
| JP | 6-277369 | 1/1983 |
| JP | 62-104770 | 12/1985 |
| JP | 6-46673 | 7/1991 |
| JP | 6-11674 | 7/1992 |
| JP | 11-114246 | 9/1997 |

* cited by examiner

*Primary Examiner*—Charles Goodman
(74) *Attorney, Agent, or Firm*—Wenderoth, Lind & Ponack L.L.P.

(57) ABSTRACT

An in-line double-sided manual safety straight razor having dual razor-sharp cutting edges includes a pair of razor blades detachably mounted respectively, between tenons of a handle portion and a middle platform structure of a blade spacing portion. Both of the angles of the razor blade cutting strips are sharpened symmetrically and face outwardly so that an angle of inclination of the imaginary lines $L_1$, $L_2$ linking the tip of the razor blade strips and the rounded elongated lower portion is between 20–30 degrees with respect to the skin surface for safe and easy shaving of hair from the surface of a skin.

5 Claims, 2 Drawing Sheets

MANUAL SAFETY STRAIGHT RAZOR HAVING DOUBLE-SIDED BLADES

BACKGROUND OF THE INVENTION

1. Field of the Invention

This invention relates to a manual safety straight razor having double-sided razor blades. More particularly, the invention relates to an in line double-sided straight razor blade manual safety straight razor having dual razor sharp cutting edges positioned between front and rear guards which can be easily used both by professionals and at home users either by pulling or pushing a razor blade strip for precise and safe shaving of hair from the face and other body regions.

2. Description of the Prior Art

There are different kinds of razors, such as professional use, at home use or disposable razors in the market. Since a sharp blade of a razor is used in direct contact with the skin or neck to remove hair from the skin, vigilant attention must be given to shaving. In order to avoid a possible accidental cut, nick or scrape from using a straight razor by the hands of at home users other than a barber or beautician, the T bar razors have been widely used and are still in use.

Since the advent of blood infected communicable diseases such as AIDS, the HIV virus, hepatitis and other diseases, there has been a serious social health problem. Even trained professional such as barbers or beauticians will from time to time accidentally cut, nick or scrape the skin of their customers with razors, causing some minor bleeding. Barbers beauticians and healthcare workers are reluctant to come into contact with blood from others, however, and tend to avoid tasks where such contact is likely. Due to the above circumstances, special sterilization has been required recently for professional razors used in the barbershops or beauty parlors by a public health center.

In order to avoid an accidental cut, nick or scrape of the skin, not only is vigilant attention is requested even for the skilled barber or beautician, but also a safety razor has also been proposed. U.S. Pat. No. 6,164,290 to Edward A. Andrews discloses a double-sided straight razor shaving device having dual razor sharp cutting edges positioned between front and rear guards, and an in line handle which can easily be gripped for precise shaving of the face and other body regions. This double-sided safety has four razor strips, which cannot be used for pull and push shavings. This double-sided safety has four razor strips, which cannot be used for both pulling and pushing shaving methods.

The Japanese Patent Publication No. 114246/1999 (not examined) discloses a change blade type razor and a method of shaving hair from the face and other body regions, whereby a safe and slanted shaving process can be easily carried out even by an unskilled user. The Japanese Patent Publication No. 277369/1994 (not examined) discloses a wet-type razor device 1 which comprises a long handle portion 2, a shaving portion 3 mounted to the long handle portion 2 by fixing parts 9 and 26, whereby a shaving hair from the face and other body regions can be carried out.

The Japanese Utility Model Publication No. 11674/1994 (not examined) discloses a safety razor having double-sided blades, and includes a handle portion 1, an elongated from cutter portion 2, and a pair of razor blades 7 and 8 provided at both side portions of the front cutter 2 so that both pack portions 7*b* and 8*b* are located at both side portions of a back portion 2*b* of the front cutter portion 2. A plane Q linking the belly 2*a* of the front cutter portion 2 extending to the back portion 2*b*, including a pair of razor blade strips 7*a* and 8*a*, and a plane R linking the razor blade strips 7*a* and 8*a* and the back portion 7*b* and 8*b* are substantially parallel to each other, or a space between the planes Q and R is narrowed gradually from the back portion 2*a* of the front cutter portion 2 into the belly 2*a*.

The razor shown in the Japanese Utility Model Publication No. 104770/1987 (not examined) has a handle portion 1, a pair of connecting portions 2 and 2, a pair of support portions 3 and 3, and a pair of blade strips 4 and 4 held into the support portions 3 and 3, a sponge 5 inserted between the blade strips 4 and 4 and the support portions 3 and 3.

The razor holder described in the Japanese Utility Model Publication No. 104770/1987 (not examined) includes a handle portion 1 having a holder 1*b* having a holder 1*b*, which comprises a groove 3, whereby a razor blade strip can be easily made.

The in-line double-sided manual safety straight razor of this invention is based on the inventor's many years of experience as a barber, and on the inventor's observation that the angle of inclination of the plane linking a bottom portion of a blade edge of a razor and a rounded elongated lower portion of a top elongated wide complementary head portion must have an angle between 20–30 degrees with respect to the skin surface. In this regard, if the angle of inclination of the plane linking a blade edge of a razor and a rounded elongated lower portion of a top elongated wide complementary head portion of a top elongated wide complementary head portion is below 20 degrees, the shaving angle of the hair blade edge becomes a dull scraping angle, thus causing insufficient shaving of facial hair. However, if the inclination angle is over 30 degrees, the blade edge becomes a sharp edge which can cut the skin accidentally.

SUMMARY OF THE INVENTION

A principal object of this invention is to provide a manual safety straight razor having double-sided blades that can be easily used both by professionals and at home users either by pulling or pushing the razor blade strips of the manual safety razor for easy, precise and safe shaving of hair from the face and other body regions.

Another object of this invention is to provide a manual safety straight razor having double-sided blades whereby an accidental cut, nick or scrape of the skin can be avoided. Thus, infection from blood-infected communicable diseases such as AIDS, the HIV virus, hepatitis and other serious diseases can be prevented.

Another object of this invention is to provide a manual safety straight razor having double-sided blades, in which both angle of inclination of planes linking the razor blade strips of the manual safety straight razor and a rounded elongated lower member portion are between 20–30 degrees in order to fit the razor blade strips on the skin surface with a given shallow and safe angle of inclination for shaving.

Another object of this invention is to provide a manual safety straight razor having double-sided bladed, in which both of the angles of inclination of planes linking the razor blade strips of the razor blades and a rounded elongated lower member portion of the razor structure is between 20–30 degrees with respect to the skin surface in order to enable a user to either pull or push the razor blade strips on the skin surface.

Another object of this invention is to provide a manual safety straight razor having double-sided blades which can be easily used both by professionals and at-home users either by pulling or pushing the razor blade strip for precise and safe shaving of hair from the face and other body regions.

Another object of this invention is to provide a manual safety straight razor having double-sided blades which can be easily pulled or pushed by wrist motion of a user.

Another object of this invention is to provide a manual safety straight razor having double-sided blades, in which a correct angle of inclination of a pair of razor blades to a face or other body regions can be easily selected.

Another object of this invention is to provide a manual safety straight razor having double-sided blades, which is simple in construction, so that it can be easily made.

Still another object of this invention is to provide a manual safety straight razor having double-sided blades that allows many individuals to use the professional services of a barber or beautician of facial shaving without anxiety.

BRIEF DESCRIPTION OF THE DRAWINGS

The object and features of the invention will become apparent from the following description taken in conjunction with the preferred embodiment thereof with reference to the accompanying drawing, in which.

DETAILED DESCRIPTION OF THE INVENTION

Figure 1:
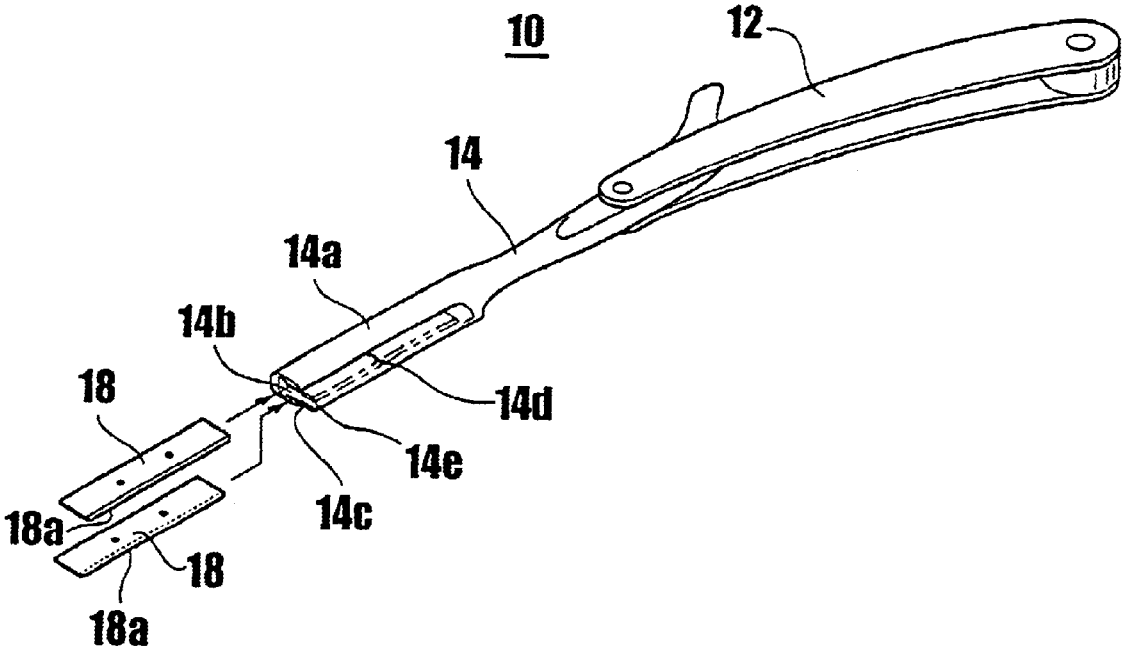
FIG. 1 is a perspective view schematically showing a pair of razor blade strips being mounted into an elongated front handle portion of a manual safety straight razor of the present invention.

Referring now to the drawings, a manual safety straight razor 10 having double-sided blades comprises an elongated rear handle portion 12 and an elongated front handle portion 14 which is pivotally secured to a front of the elongated rear handle portion 12.

Figure 2:
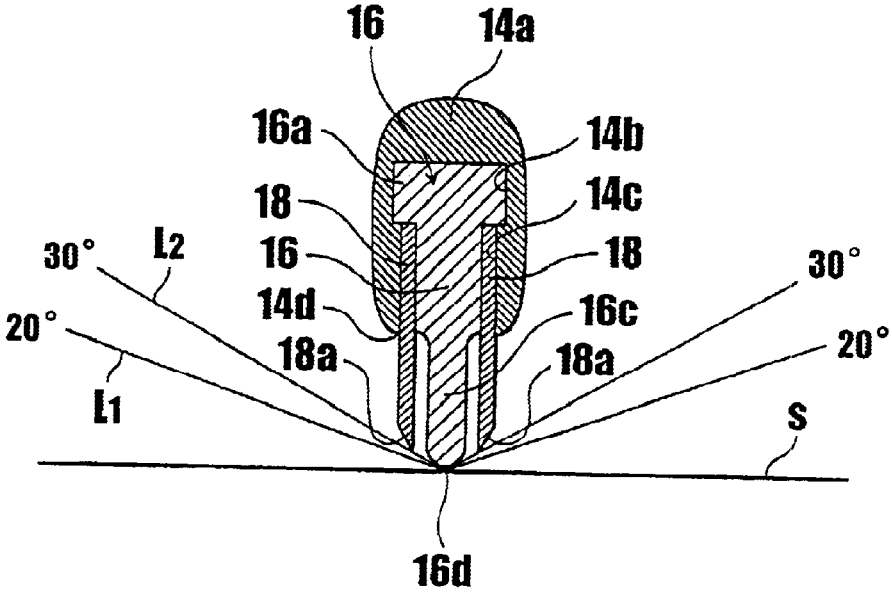
FIG. 2 is an elongated schematic longitudinal sectional view of the manual safety straight razor shown in FIG. 1.

As particularly shown in FIGS. 1 and 2, the elongated front handle portion 14 has a longitudinal cutter head portion 14*a* including an elongated wide complementary opening 14*b* and a pair of middle staged tenons 14*c*, The tenons 14*c*, 14*c* are spaced from each other to form longitudinal opening 14*e* between edge portions 14*d*, 14*d*, so as to allow blade spacing portion 16 and a pair of razor blades 18, 18 to extend outwardly through the opening 14*e*.

The blade spacing portion has a top elongated wide complementary head portion 16*a* interlocking into the elongated wide complementary opening 14*b*, a middle platform structure 16*b* extending from the top elongated wide complementary head portion 16*a*, and a lower platform structure 16*c* extending from the middle platform structure 16*b*. The middle platform structure 16*b* is a little narrower than the top elongated wide complementary head portion 16*a*, and the lower platform structure 16*c* is a little narrower than the middle platform structure 16*b*. A rounded elongated lower portion 16*d* is formed at the distal end of the lower platform structure 16*c*.

Figure 3:
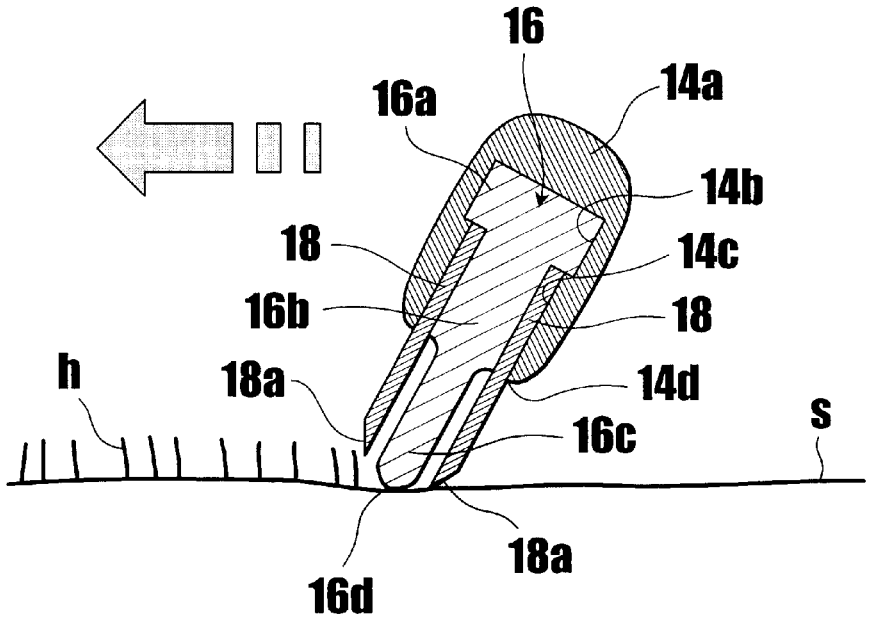
FIG. 3 is an elongated schematic longitudinal sectional view of the manual safety straight razor shown in FIGS. 1 and 2, in which one of the razor blade strips is being pulled out into a front direction.
Figure 4:
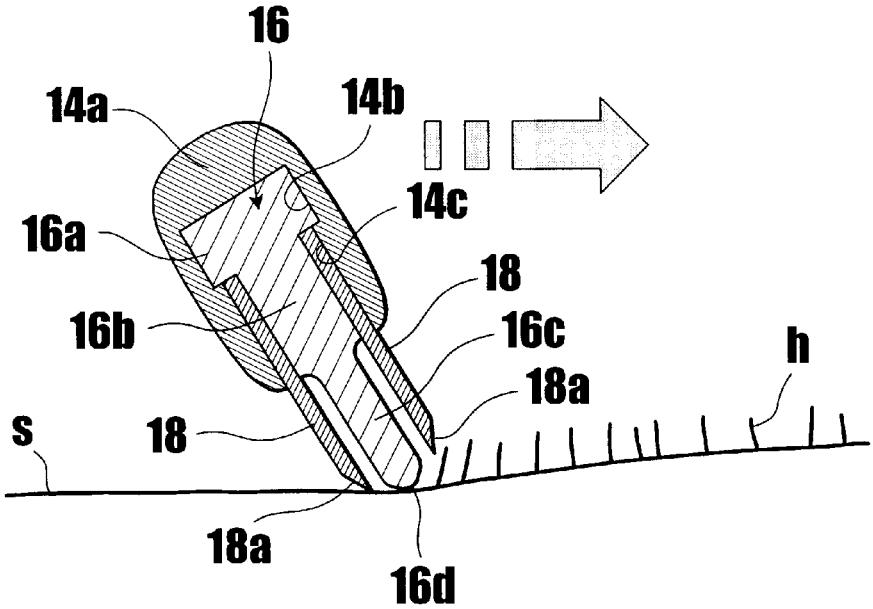
FIG. 4 is an enlarged schematic longitudinal sectional view of the manual safety straight razor shown in FIG. 3, in which another razor blade strip is being pushed to shave hair.

As shown in FIGS. 2–4, a pair of razor blades 18, 18 are detachably mounted, respectfully, between a corresponding one of the tenons 14*c* and the middle platform structure 16*b* of the blade spacing portion. A razor blade cutting strip 18*a* of the razor blade 18 is sharpened to form an outer inclined flat cutting blade portion. Accordingly, when a pair of the razor blades 18, 18 are mounted between the tenons 24*c* and the middle platform structure 16*b*, the outer inclined flat cutting blade portions of the razor blade cutting strips 18*a*, and 18*a* are arranged symmetrically and face outwardly to form an imaginary V shaped working surface.

To this end, an imaginary line $L_1$ (at an angle of 20 degrees with respect to the skin surface) representing the plane linking the rounded elongated lower portion 16*d* and the tip of the razor blade cutting strip 18*a* is formed when the manual safety razor 10 is inclined to fit the razor blade strip 18*a* to the skin's surface. Meanwhile, an imaginary line $L_2$ (at an angle of 30 degrees with respect to the skin surface) representing the plane linking the rounded elongated lower portion 16*d* and the razor blade cutting strip 18*a* if formed when the manual safety razor 10 is not inclined. Thus, it should be appreciated that an angle between the lower platform structure 16*c* and a plane orthogonal to the skin surface is between 20–30 degrees when the manual safety razor 10 is inclined to place the razor blade cutting strips 18*a*, 18*a* on the skin's surface.

In practice, the rounded elongated lower portion 16*d* of the razor structure 16 is placed on the skin. Subsequently, the front handle portion 14 is inclined to touch an edge portion of the razor blade 18 on the surface of the skin s to form a proper angle of inclination of between 20–30 degrees between the plane orthogonal to the skin surface and the platform structure 16*c*.

In view of the fact that both the angle of inclination of planes linking the tip of the razor cutting blade strips 18*a*, 18*a* of the razor blades 18, 18 and the rounded elongated lower portion 16*d* are between 20–30 degrees with respect to the skin surface, the razor blades 18, 18 are fitted softly at a suitable angle to the surface of the skin. Therefore, easy, safe and reliable shaving of hair h from the surface of the skin s can be carried out not only by the barber and beautician, but also by an unskilled user.

Accordingly, the desired angles of inclination between the razor blades 18, 18, and the plane orthogonal to the skin surface can be easily adjusted between 20–30 degrees. As a result, the hair h can be shaved from the face and other body regions softly, safely and reliably without causing an accidental cut, nick or scrape of the skin.

At the same time, both pulling and pushing motions of the inclined surface of the razor blade cutting strips 18*a*, 18*a* can be carried out easily and freely by the wrist motion of a user.

It is to be understood that the in-line angle safety straight razor of this invention is by no means limited to the particular construction and uses herein described, disclosed and/or shown in the drawing. It is also to be understood that modifications to the invention as described may be made, as might occur to one with skill in the field of the invention, within the scope of the appended claims. All embodiments contemplated hereunder, which achieve the objects of the invention.

Other embodiments may be developed without departing from the spirit of the invention or from the scope of the appended claims.

What is claimed is:

1. A manual double-sided safety straight razor comprising:

a rear handle portion;

a front handle portion having a rear end pivotally connected to a front end of said rear handle portion, said front handle portion having a head portion with a wide complementary space formed therein and having a pair of parallel and spaced-apart tenons extending from said head portion so as to form a narrow longitudinal opening extending from said wide complementary space;

a blade spacing portion having a wide upper complementary head portion fitted within said wide complementary space of said front handle portion, having a middle platform portion narrower than said wide upper complementary head portion and extending from said wide upper complementary head portion through said narrow longitudinal opening of said front handle portion, and having a lower platform portion narrower than said middle platform portion and extending from said middle platform portion, said lower platform portion having a rounded distal end; and a pair of razor blades, each of said razor blades having an inclined flat cutting portion and being arranged between a respective one of said tenons of said front handle portion and said middle platform portion of said blade spacing portion, said pair of razor blades being arranged such that a plane connecting a cutting edge of each of said razor blades and said rounded distal end of said blade spacing portion from an angle in a range of 20 degrees to 30 degrees with respect to a skin surface when said straight razor is held orthogonal to the skin surface.

2. The straight razor of claim 1, wherein said pair of razor blades are arranged such that said inclined flat cutting portion of each of said razor blades faces away from said blade spacing portion to form an imaginary V-shaped working surface with said rounded distal end of said blade spacing portion.

3. The straight razor of claim 1, wherein said pair of razor blades are parallel to said blade spacing portion.

4. The straight razor of claim 3, wherein said pair of razor blades are spaced apart from said lower platform portion of said blade spacing portion such that a gap is formed between each of said razor blades and said lower platform portion.

5. The straight razor of claim 1, wherein said straight razor comprises only two razor blades.

* * * * *